US005203260A

United States Patent [19]

Fukuda et al.

[11] Patent Number: 5,203,260

[45] Date of Patent: Apr. 20, 1993

[54] BINDING APPARATUS FOR BINDING A BUNDLE OF LABLES OR THE LIKE

[75] Inventors: Michio Fukuda, Nishinomiya; Hiroshi Kagei, Kuwana, both of Japan

[73] Assignee: Sumitomo Wiring Systems, Ltd., Yokkaichi, Japan

[21] Appl. No.: 779,271

[22] Filed: Oct. 18, 1991

[30] Foreign Application Priority Data

Nov. 2, 1990 [JP] Japan ..... 2-298361

[51] Int. Cl.[5] ..... B65B 13/02

[52] U.S. Cl. ..... 100/9; 24/16 R; 53/585

[58] Field of Search ..... 100/9, 212, 236; 24/16 R; 29/235; 53/399, 582, 556, 585

[56] References Cited

U.S. PATENT DOCUMENTS

| | | | |
|---|---|---|---|
| 2,236,936 | 4/1941 | Camp | 53/585 X |
| 2,376,138 | 5/1945 | Harrison | 53/585 X |
| 3,186,333 | 6/1965 | Hoffman et al. | 100/9 |
| 3,288.055 | 11/1966 | Vellrath | 53/585 X |
| 4,127,978 | 12/1978 | Lucke | 100/9 X |
| 4,188,871 | 2/1980 | Teachout | 100/9 X |
| 4,335,490 | 6/1982 | Teachout | 100/9 |
| 4,470,241 | 9/1984 | Parry et al. | 100/9 X |
| 4,601,155 | 7/1986 | Lewis | 53/585 X |

FOREIGN PATENT DOCUMENTS 3619089 12/1987 Fed. Rep. of Germany .

*Primary Examiner*—Stephen F. Gerrity
*Attorney, Agent, or Firm*—Sughrue, Mion, Zinn, Macpeak & Seas

[57] ABSTRACT

A binding apparatus has a pair of arms provided on a frame so as to be pivotal in opposite directions. A gear mechanism interlocks the arms with each other. Hooks are provided on an end of each of the arms between which a rubber band, shorter than a bundle of cables in the peripheral length thereof is spanned having a slidable rod coupled thereto. A maintaining device maintains the open position of the arms, and a releasing device releases the maintaining device. When an unlocking lever is pressed downward by the weight of a bundle of electric cables placed in the center of the rubber band spanned between both hooks provided on both arms while in the open position, the stopper disengages from the gear and the arms pivot toward each other to place the rubber band around the bundle.

2 Claims, 5 Drawing Sheets

BINDING APPARATUS FOR BINDING A BUNDLE OF LABLES OR THE LIKE

BACKGROUND OF THE INVENTION

1. Field of the Invention

The present invention relates to an apparatus for binding a bundle of cables with a rubber band.

2. Description of the Related Arts

In the process of manufacturing a wire harness of an automobile, the length of an electric cable is measured, the electric cable is cut, and a terminal is attached thereto. After all products manufactured in this process are inspected, cables are divided into a plurality of bundles each having a predetermined number of cables. Then, as shown in FIG. 9, bundles are bound at several portions in the vicinity of terminals of each bundle with a rubber band (a).

Each bundle (b) is bound with the rubber band (a) as shown in FIG. 8. Conventionally, as shown in FIG. 10, the bundle (b) and a mushroom-shaped hook of the rubber band (a) are gripped with one hand and the rubber band (a) is wound around the bundle (b) with the other hand to lock the bundle (b) with the hook.

However, this operation requires skillfulness and workmanship as well as much time and labor. Thus, sufficient operation efficiency cannot not obtained.

SUMMARY OF THE INVENTION

Accordingly, an essential object of the present invention is to provide a binding apparatus not requiring a high degree of dexterity.

In accomplishing these and other objects, according to the present invention, there is provided a binding apparatus having a frame and a pair of arms provided on the frame and vertically pivotal in opposite directions, wherein the moment at each pivotal axis thereof due to the dead weight thereof is greater in the outward direction than in the inward direction when the arms are in the closed position. A gear mechanism interlocks the arms with each other so that the arms are pivoted thereby in opposite directions at the same speed. Hooks are provided on an end of each of the arms between which a rubber band, having a mushroom-shaped hook attached thereto, shorter than a bundle of cables in the peripheral length thereof is spanned. The interval between one of the hooks and the pivotal axis of one of the arms is longer than the interval between the other hook and the pivotal axis of the other arm. A cylinder, is provided on one of the arms, in which when a rod moves forward, the arms pivot into the closed position thereof so that a portion of the rubber band hooked by one of the hooks is moved toward the other hook and a maintaining device keeps the open position of the arms while a releasing device releases the maintaining device.

The binding apparatus further has a stopper, vertically movable and serving as the maintaining device, inserted into an opening formed on a gear of the gear mechanism so as to keep the open position of the arms. Also a spring is provided on the stopper so as to urge the stopper toward the gear and an unlocking lever is provided in the center between the pivotal axes of each of the arms, which serves as the releasing device and moves downward from the gear against the urging force of the spring when the unlocking lever is pressed downward by the weight of the bundle of cables.

In the above description, the length of the rubber band means a length when it is linear.

According to the above construction, when the unlocking lever is pressed downward by the weight of a bundle of electric cables placed in the center of the rubber band spanned between both hooks provided on both arms kept in the open position, the stopper disengages from the gear. Thus, the arms are unlocked from the open position. If the unlocking lever is not provided, the arms are manually moved to assume the closed position.

Thereafter, the arms pivot into the closed position by the contraction force of the rubber band at the same speed because they are each connected with a gear rotating at the same speed. Thus, the rubber band is guided around the bundle of cables.

Upon forward movement of the rod of the cylinder after both ends of the rubber band are located above the bundle of cables, one end of the rubber band hooked by the hook 10*a* passes above its other end hooked by the hook 10*b*, namely, the upper surface of the hook is in a mushroom configuration, thus being hooked by the hook. Then, the rod moves backward with the rubber band locked by the hook because the length of the rubber band is shorter than the circumference of the bundle of cables.

When the rubber band is removed from both hooks, the dead weight of the arms causes the arms to pivot into the open position. When the arms are in the initial condition, namely, the open position, the stoppers are inserted into the locking holes of the gear by the urging force of the spring when the bundle of cables is removed from the unlocking lever.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
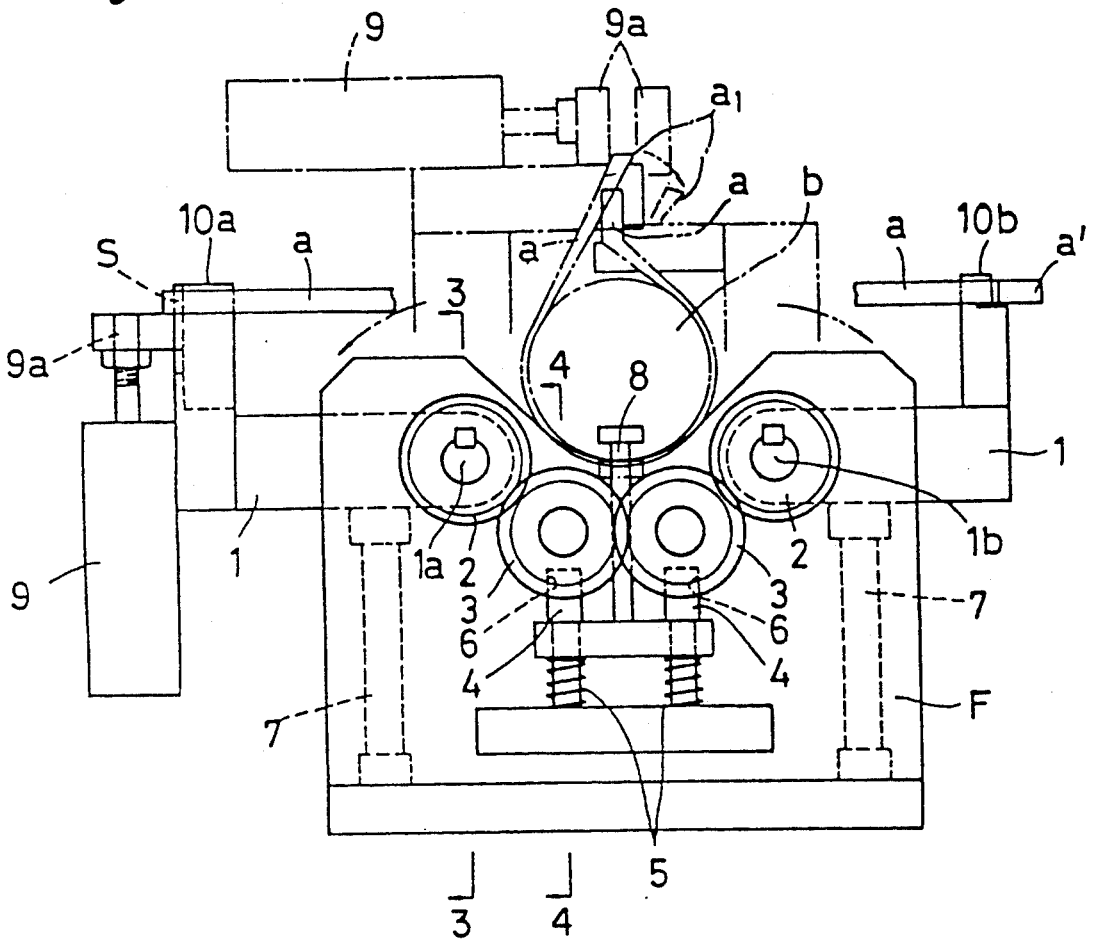
FIG. 1 is a a front view showing a binding apparatus according to an embodiment of the present invention.

Before the description of the present invention proceeds, it is to be noted that like parts are designated by like reference numerals throughout the accompanying drawings.

Referring now to the accompanied drawings, the embodiments of the present invention will be described below.

As shown in FIGS. 1 through 4, a frame (F) is provided with a pair of arms 1 and 1 which pivot vertically in opposite directions about axes 1*a* and 1*b*. Gears 2 and 2 of the same size are fixed to the pivotal axes 1*a* and 1*b* of the arms 1 and 1, respectively. The frame (F) is further provided with gears 3 and 3, of the same size, engaging each other and the gears 2 and 2, respectively. This gear mechanism allows the arms 1 and 1 to pivot at the same speed in opposite directions.

Stoppers 4 and 4 positioned below the gears 3 and 3 are vertically movably supported by the frame (F). The stoppers 4 and 4 are urged upward by springs 5 and 5 provided on the stoppers 4 and 4, respectively. As shown in FIG. 1, when both arms 1 and 1 are horizontal, i.e., when they are in the open position, the upper end of each stopper 4 is inserted into locking hole 6 formed on the gear 3 so as to keep the arms 1 and 1 horizontal, namely, in the open position. The stoppers 4 and 4 are inserted into the holes 6 and 6 by adjusting the screw amount of stoppers 7 and 7 into the arms 1 and 1 which contact the stoppers 7 and 7 in the downward movement of the arms 1 and 1.

An unlocking lever 8 vertically extending beyond the gear 3 is provided in the center between the stoppers 4 and 4. Upon downward movement of the lever 8 from the position shown by a solid line of FIG. 1 to the position shown by a one-dot chain line of FIG. 1, the stoppers 4 and 4 move downward and unlocked from the locking holes 6 and 6. Thus, the arms 1 and 1 are unlocked from the open position, i.e., they start pivoting upward.

Hooks 10*a* and 10*b* are provided on an end of each arm 1, respectively. The hook 10*a* is sectionally semicircular. The portion of the hook 10*a* which is mounted on the arm 1 is solid, and the peripheral portion thereof is semicylindrical. The hook 10*b* is sectionally elliptical and is cylindrical in the peripheral portion thereof. The distance between the hooked portion of the rubber band (a) hooked by the hook 10*a* and the pivotal axis 1*a* of one arm 1 is a little longer than the distance between the hooked portion of the rubber band (a) hooked by the hook 10*b* and the pivotal axis 1*b* of the other arm 1. Thus, when the arms 1 and 1 are in the closed position, an end portion (hooked portion) $a_1$ of the rubber band (a) passes above a hook (a') and thus the rubber band (a) can be smoothly locked at the end portion $a_1$ thereof and the other end portion opposed thereto. One of the arms 1 is provided with an air cylinder 9. Upon forward movement of the rod 9*a* of the air cylinder 9 through the guide of a slit (S) of the hook 10*a*, the arms 1 and 1 pivot into the closed position.

When the arms 1 and 1 are in the closed position as shown by one dot chain lines in FIG. 1, the moment of the arms 1 and 1 at its pivotal axes 1*a* and 1*b* due to its dead weight including the weight of the air cylinder 9 is each set to be greater in the outward direction than in the inward direction as shown by arrows of FIG. 1. Thus, when the rubber band (a) is removed from the hooks 10*a* and 10*b* in the closed position of the arms 1 and 1, the arms 1 and 1 pivot into the open position due to their weight.

The operation of the binding apparatus of the above-described construction is described below.

As shown by a solid line of FIG. 1, when the arms 1 and 1 are in the open position, the rubber band (a) is spanned automatically or manually between the hooks 10*a* and 10*b* with the rubber band (a) stretched.

When a bundle (b) of electric cables is supplied downward to the center of the rubber band (a) as shown by a one-dot chain line with the arms 1 and 1 set in the open position, namely, in the initial condition of the arms 1 and 1, the unlocking lever 8 is pressed downward by the weight of the cable bundle (b) through the rubber band (a) and as a result, the stoppers 4 and 4 move downward and disengage from the locking holes 6 and 6 of the gears 3 and 3, respectively. As a result, the arms 1 and 1 pivot into the closed position due to the contraction force of the rubber band (a) as shown by a one-dot chain line, thus guiding the rubber band (a) onto the periphery of the cable bundle (b).

Figure 5:
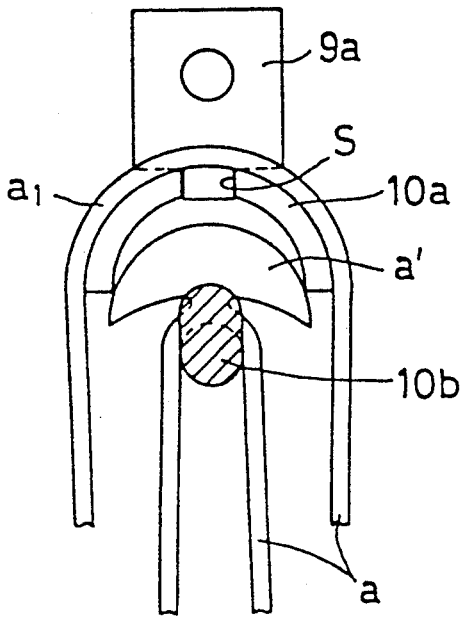
FIG. 5 is a descriptive view showing the locking operation of a rubber ring.

Upon forward movement of the rod 9*a* of the air cylinder 9 as shown by a one dot chain line of FIG. 1 after both end portions (hooked portions) of the rubber band (a) are located above the upper surface of the cable bundle (b), the end portion ($a_1$) of the rubber band (a) passes above the upper surface of the other end portion thereof, namely, the upper surface of the hook (a') as shown in FIGS. 1 and 5. Consequently, the end portion ($a_1$) of the rubber band (a) disengages from the hook 10*a* and is hooked by the hook (a'). Then, the rod 9*a* moves backward with the rubber band (a) locking the cable bundle (b). The movement amount of the rod 9*a* is set by an automatic control in consideration of the circumference of the cable bundle (b).

When the rubber band (a) spanned between both hooks 10*a* and 10*b* are removed therefrom, the arms 1 and 1 pivot into the open position due to their own weight. When the cable bundle (b) is removed from the unlocking lever 8 in the initial condition of the arms 1 and 1, the stopper 4 is inserted into the locking hole 6 of the gear 3 by the spring 5.

Figure 6:
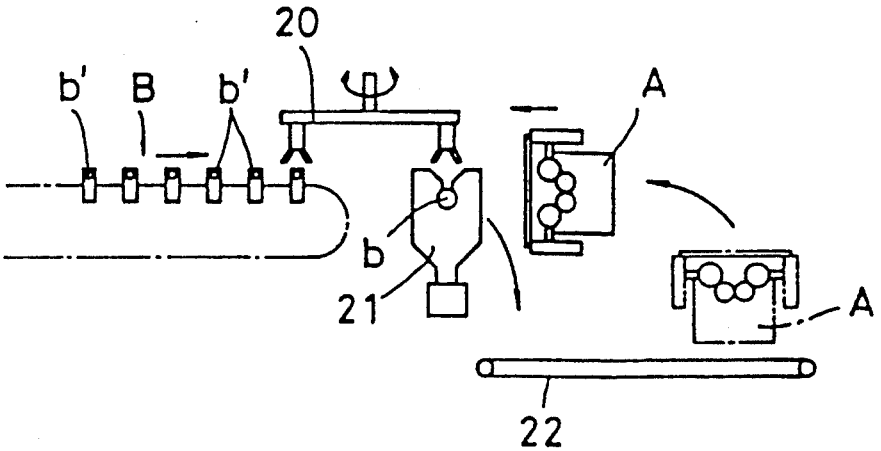
FIGS. 6 and 7 are schematic views showing a use example of the embodiment.
Figure 7:
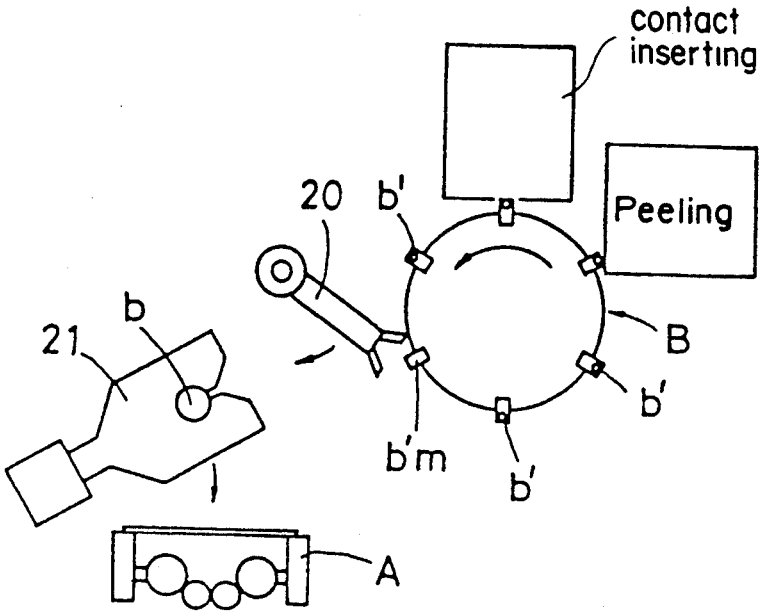
Figure 8:
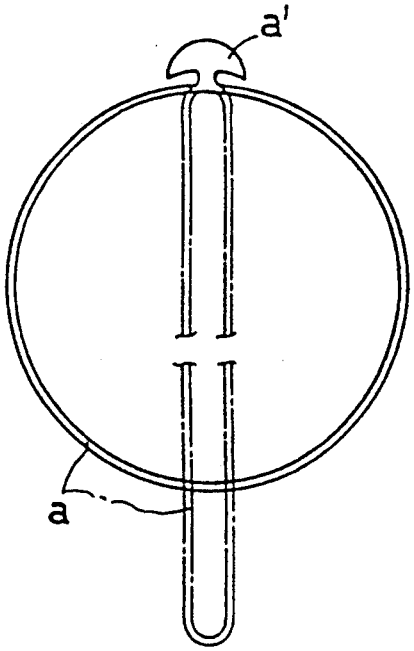
Fig. 8 PRIOR ART
FIG. 8 is a front view showing a rubber ring.
Figure 9:
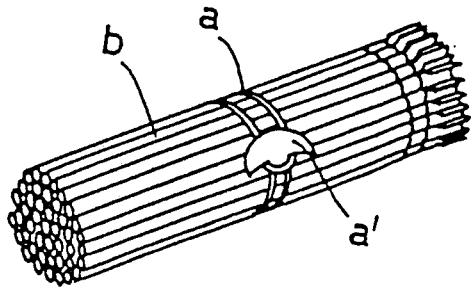
Fig. 9 PRIOR ART
FIGS. 9 and 10 are descriptive views showing the operation for binding a bundle of electric cables.
Figure 10:
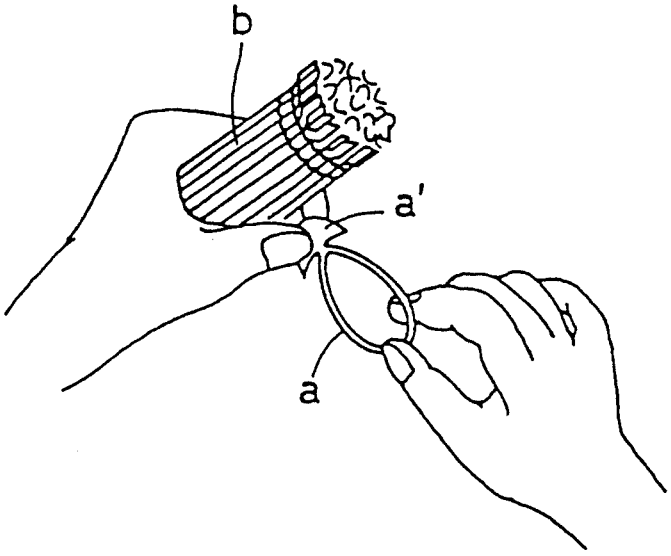
Fig. 10 PRIOR ART

The binding apparatus (A) is used as shown in FIGS. 6 and 7. That is, cables (b') fed from a known (B) are stocked in a cable holding hand 21 through a cable hand 20. When a predetermined number of cables (b') has been stocked in the cable holding hand 21, the cable bundle (b) is guided to the binding apparatus (A) by moving the cable holding hand 21 as shown in FIG. 7 or the binding apparatus (A) as shown in FIG. 6. Then, the cable bundle (b) is bound with a rubber band according to the operation described above. After the cable bundle (b) is bound, the bound bundle (b) is transported to the subsequent process by a belt conveyor.

Figure 2:
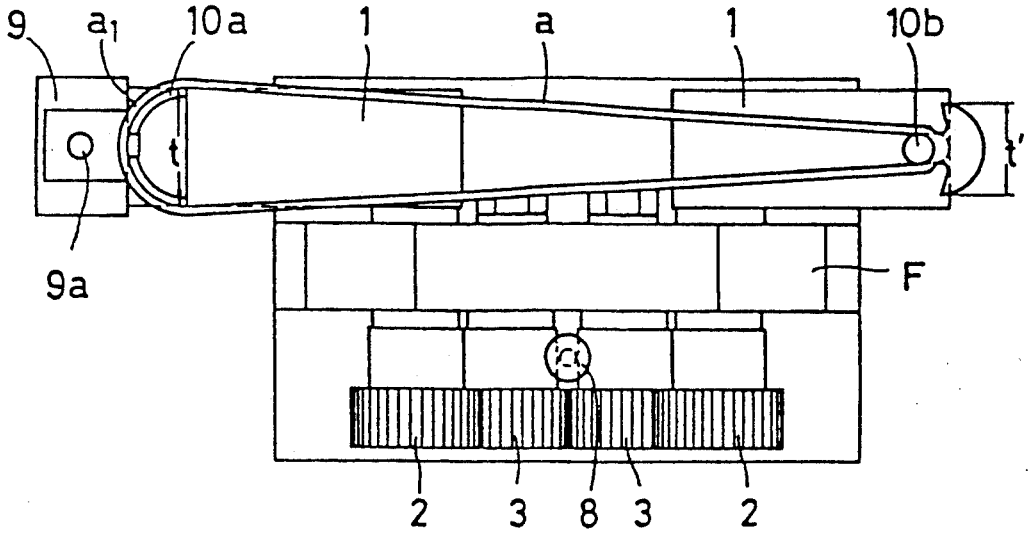
FIG. 2 is a plan view showing the binding apparatus shown in FIG. 1.
Figure 3:
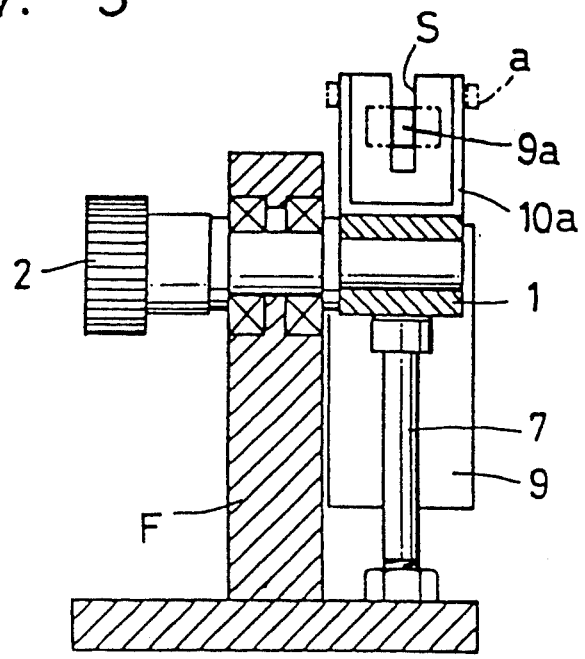
FIG. 3 is a view taken along the III—III line of FIG. 1.
Figure 4:
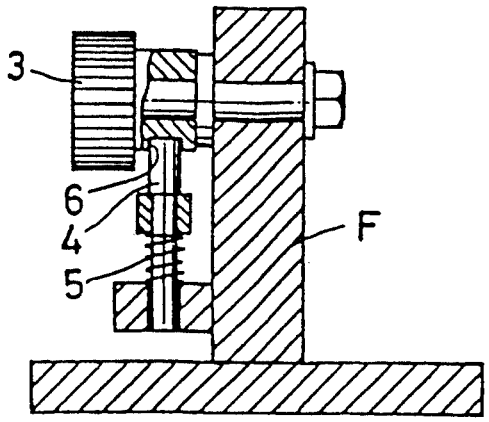
FIG. 4 is a view taken along the IV—IV line of FIG. 1.

The arms 1 and 1 may be mounted on the gear 3 without the gear 2. In this case, the mounting direction and the length of the hooks 10*a* and 10*b* are appropriately set so that the arms 1 and 1 do not interfere with the cable bundle (b) in supplying it to the unlocking lever 8 and both end portions (hooked portions) of the rubber band (a) are located above the cable bundle (b) when the arms 1 and 1 pivot into the closed position. The top end of the rod 9*a* may serve as the hook 10*a* so that the rod 9*a* serves as a means for hooking the rubber band (a). In this case, the hooking width (t) of the rod 9*a* shown in FIG. 2 is smaller than the width (t') of the hook (a') so that the end portion $a_1$ (hooked portion) of the rubber band (a) passes above the hook (a') by flexing the hook (a').

The binding apparatus according to the present invention may be employed to bind other things, the configuration of which are an electric cable as well as the electric cable bundle (b).

According to the above construction, the arms pivot into the closed position owing to the contraction force of a rubber band so as to wind the rubber band around a bundle of cables. After the bundle of cables is bound with the rubber band, the arms 1 and 1 return to the open position, namely, the initial condition due to their own weight. Accordingly, the binding apparatus reliably binds bundles successively without much time and labor as well as skillfulness and workmanship, so that it can be manufactured at a low cost.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A binding apparatus comprising:

a frame;

first and second arms each having a first end which is pivotally mounted at a pivot point on said frame so as to be pivotal about first and second axes respectively, a respective moment about said first and second axes of each of said arms due to the weight thereof tending to move second ends of said arms, which are opposite said first ends, away from each other when said arms are in a closed position at which said second ends of said arms are proximate each other;

a gear mechanism operatively coupled to said arms so as to interlock said arms with each other so that said arms pivot in opposite directions at the same speed;

first and second hooks respectively provided on each of said second ends of said arms between which a rubber band, having a mushroom-shaped latch attached thereto, is spanned, a linear length of said rubber band being shorter than a circumference of a bundle of cable to be bound, a first distance between said first hook and said first pivotal axis being longer than a second distance between said second hook and said second pivotal axis;

a cylinder, provided on said first arm and having a rod slidably mounted therein, when said arms pivot into said closed position said cylinder moves said rod so as to cause a push member, which is mounted on an end of said rod, to push a portion of said rubber band so that said portion of said rubber band hooked by said first hook is moved toward said second hook;

a maintaining device coupled to said gear mechanism so as to keep said arms in an open position wherein said second ends are remote from one another; and a releasing device coupled to said maintaining device so as to release said maintaining device.

2. A binding apparatus as defined in claim 1 wherein said maintaining device is a stopper, slidably mounted on said frame so as to be vertically movable, said gear mechanism comprising at least one year, said stopper being insertable into an opening formed on one of said gears of said gear mechanism so as to prevent said one of said gears from moving and maintain said arms in said open position, a spring being provided on said stopper so as to urge said stopper toward said gear, said releasing device being an unlocking lever provided at a position between said first and second pivotal axes and coupled to said stopper, an end of said unlocking lever being positioned below the bundle of cable and being movable so as to push said stopper against the urging force of said spring when said unlocking lever is pressed downward by the weight of the bundle of cable.

* * * * *